United States Patent [19]

Kruzell

[11] 3,955,470

[45] May 11, 1976

[54] BOLT OPERATING AND LOCKING MECHANISM FOR CLOSED BREECH ROCKET GUN

[76] Inventor: George R. Kruzell, 301 Hotchkiss, Bay City, Mich. 48706

[22] Filed: Apr. 24, 1975

[21] Appl. No.: 571,296

Related U.S. Application Data

[63] Continuation-in-part of Ser. No. 397,198, Sept. 13, 1973, abandoned.

[52] U.S. Cl. ..... 89/185; 89/1.801; 89/188

[51] Int. Cl.[2] ..... F41D 3/06

[58] Field of Search ..... 89/1.801, 185, 188, 89/191, 198

[56] References Cited

UNITED STATES PATENTS

| | | | |
|---|---|---|---|
| 749,341 | 1/1904 | Tobisch | 89/185 |
| 1,430,661 | 10/1922 | Lewis | 89/185 |
| 2,356,595 | 8/1944 | Koucky | 89/185 |
| 3,329,064 | 7/1967 | Segrest | 89/191 |
| 3,680,433 | 8/1972 | Tollinger | 89/185 |

*Primary Examiner*—Stephen C. Bentley
*Attorney, Agent, or Firm*—Watson, Cole, Grindle & Watson

[57] ABSTRACT

A closed breech rocket gun has a tubular bolt with an outwardly extending lug thereon for locking the bolt in its forwardly projected position as the lug is shifted into engagement with an abutment wall on the receiver by means of a bolt operating plate guided thereon. The bolt operating plate effects retracted and projected movements of the bolt and locks it against the rear portion of the firing chamber at the rear portion of the barrel as it engages the lug in the projected position of the bolt.

16 Claims, 8 Drawing Figures

BOLT OPERATING AND LOCKING MECHANISM FOR CLOSED BREECH ROCKET GUN

This application is a Continuation-in-Part of U.S. Pat. Ser. No. 397,198, filed Sept. 13, 1973, now abandoned.

This invention relates generally to closed breech guns, and more particularly to a bolt operating and locking mechanism for a gun adapted for use in firing rocket type missiles or projectiles.

In the rocket gun of the type to which the invention relates, the booster or propellant charge for the projectile may be in the form of a solid self-sustaining material bonded or otherwise secured to the projectile to therewith constitue a single complete ammunition round. A lock mechanism of some type is normally provided for securely locking the bolt in its breech closing position. In the firing of such a gun the bolt must make an air tight and gas tight seal with the breech opening as disclosed in my prior U.S. Pat. No. 3,333,508. The present invention relates to such a bolt and firing member sealed closing mechanism, although it is greatly improved and simplified thereby.

An object of this invention is to provide such a closed breech gun wherein the bolt is provided with an outwardly extending lug which is shifted into and out of engagement with an angled wall on the receiver by means of a sliding operating plate which effects the retracted end projected movement of the bolt, the operating plate being linked with a piston and cylinder unit connected with the valve communicating with such unit for the reception of pressurized gas therefrom for actuating the unit.

Another object is to provide such a closed breech gun wherein an angled guide opening is provided in the receiver and a guide element is provided for the operating plate, such element having an angled guide opening therein through which the lug extends as well as through the receiver opening to be thereby guided during its retracted and projected movement, but openings being wider at their forward ends than the remainder thereof so as to define an angled abutment wall.

A further object of this invention is to provide such a closed breech gun wherein the operating plate has an opening therein defining spaced walls lying at angles to the longitudinal axis of the bolt, the angled abutment wall also lying at an angle to such axis but opposite to the spaced walls angles so that a rearward one of the spaced walls contacts the lug for moving the bolt in its projected position and for causing the bolt to rotate about its axis while moving the lug into contacting engagement with the angled abutment wall, and a forward one of the spaced walls contacts the lug for moving it in its retracted position.

A still further object of this invention is to provide such a closed breech gun wherein the bolt is provided with a rotatable sleeve locked against movement axially, and the lug is provided on such sleeve. The bolt is permitted to move axially but is prevented from rotating by means of a cooperating groove and dowel.

A still further object is to provide such a closed breech gun wherein the angled guide opening in the receiver opens into the rearward end thereof so as to permit the bolt of a one-piece construction to be easily and quickly installed into the gun.

Other objects, advantages and novel features of the invention will become more apparent from the following detailed description of the invention when taken in conjunction with the accompanying drawings wherein:

FIGS. 3 and 5 showing only a portion of the bolt lock mechanism compared to that of FIG. 4;

Figure 2:
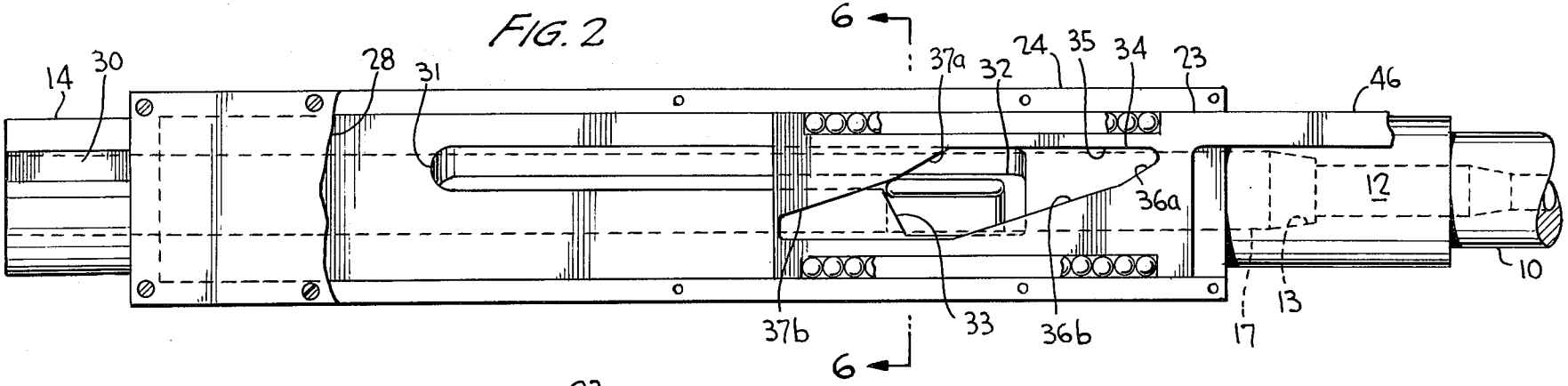
FIG. 2 is a slightly enlarged top view of the bolt lock mechanism taken along the line 2—2 of FIG. 1.
Figure 4:
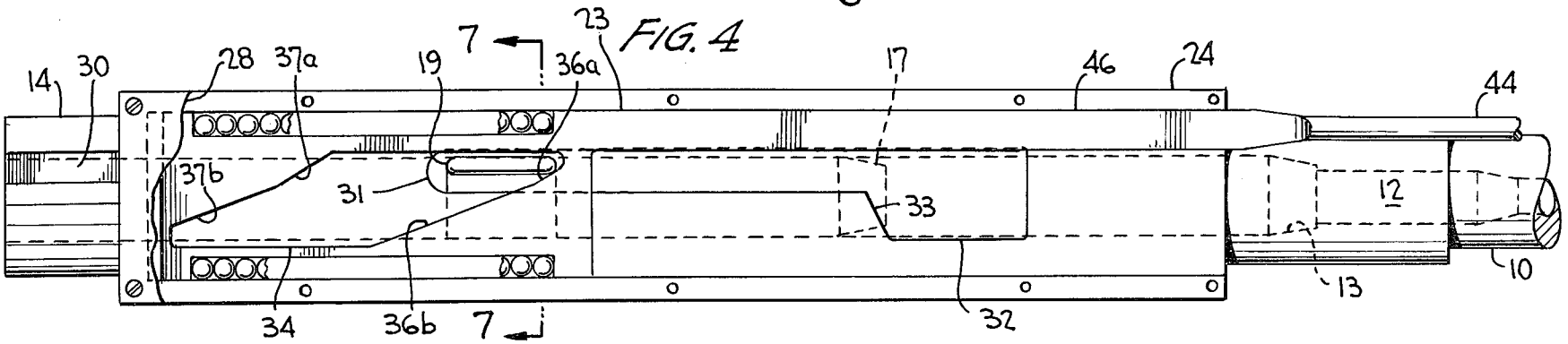
FIGS. 3, 4 and 5 are views similar to FIG. 2 showing various stages of movement of the operating plate and bolt between a retracted and forwardly projected position.
Figure 6:
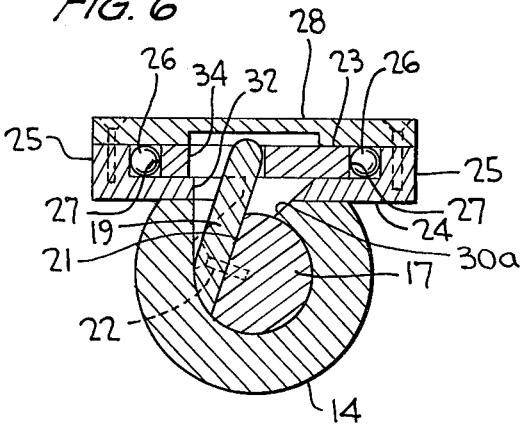
Figure 7:
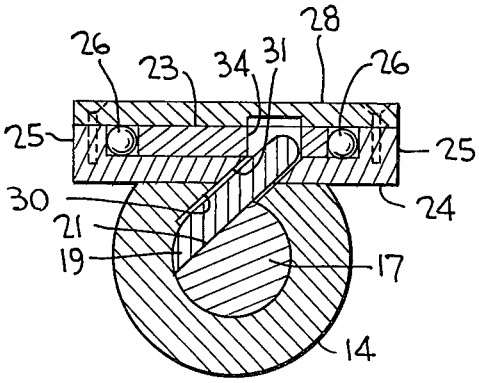
Figure 8:
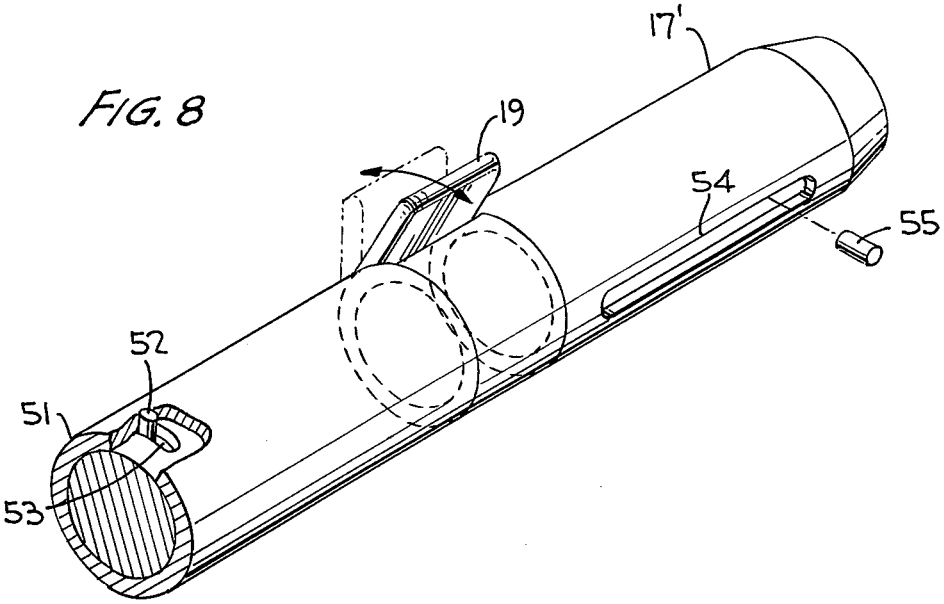

FIGS. 6 and 7 are transverse sectional views taken respectively along lines 6—6 and 7—7 of FIGS. 2 and 4; and FIG. 8 is a perspective view of a different embodiment of the bolt with the lug mounted thereon.

Figure 1:
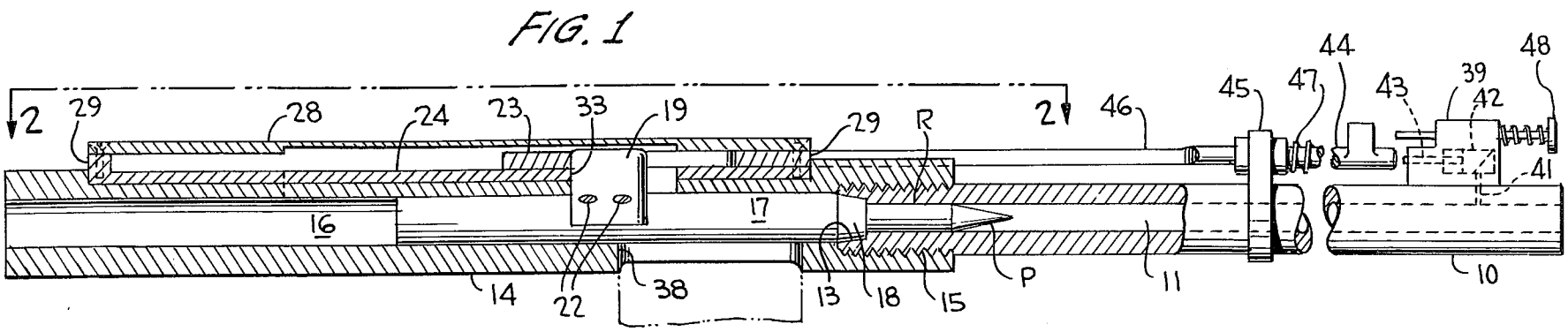
FIG. 1 is a side elevational view partly in section showing the essential portions of a rocket gun embodying the invention.

Turning now to the drawings wherein like reference characters refer to like and corresponding parts throughout the several views, FIG. 1 illustrates part of an automatically firing closed breech rocket gun with those elements not needed for an understanding of the invention being omitted for the sake of clarity. For example, not shown are the firing pin, gun stock, gun grip, trigger means, cartridge magazine and other minor details otherwise provided for such a rocket gun. The firearm comprises a conventional gun barrel 10 with a bore 11 extending therethrough, and having a firing chamber 12 (FIG. 2) formed at its rearward end. The firing chamber terminates rearwardly in a breech opening defined by a conical annular sealing surface 13. The barrel is fixed to the forward end of a generally tubular receiver 14 as by means of a threaded coupling 15. Bolt well 16 defined by the interior of the receiver is aligned with bore 11 and guides a bolt 17 for movement between a rearwardly retracted open position and a forwardly projected closed position. A conical surface 18 is provided at the forward end of the bolt for sealing engagement with the interior conical surface 13 of the breech opening located at the rearward end of the firing chamber.

A lug member 19 is mounted on a flat surface 21 of the bolt between its ends and is secured to place as by welding and/or screw fasteners 22. The bolt is moved between its retracted and forward projected positions by means of a bolt operating plate 23 mounted for sliding movement along the longitudinal axis of the bolt by means of a guide plate 24 mounted on the receiver. The guide plate comprises an upwardly open channel member having spaced side walls 25 for guiding the operating plate, and ball bearings 26 are confined within cutout portions 27 at opposite side edges of the operating plate and bear against the inner side surfaces of walls 25 for permitting smooth sliding movement of the operating plate with respect to guide 24. Moreover, a cover plate 28 is secured along the top edges of side walls 25 and end walls 29 of the guide plate for closing the operating plate and the bolt lug.

The receiver is provided with an angled guide opening 30 open at the rearward end of the receiver as shown in FIG. 2. The side walls of this opening lie at an angle parallel to surface 21 of the bolt in its retracted movement, as shown in FIG. 7. Opening 30 is wider at its forward end as at **30*a* (FIG. 6**).

The guide plate is also provided with an angled guide opening 31 with the side walls thereof forming smooth and outward extensions of the side walls of opening 30 (see FIG. 7). The guide plate is wider at its forward end as at 32, the walls of this wider opening forming smooth and outward extensions of wider opening 30*a* (see FIG. 6). Both of these wider openings define coincident abutment walls 33 together with the remainder of their respective openings.

Bolt operating plate 23 is provided with a slightly elongated opening 34 of a size much greater than the cross-sectional size of lug 19. This opening is defined by spaced and parallel side walls 35 as well as by spaced and parallel end walls comprising end wall portions 36*a*, 36*b* and 37*a*, 37*b*. As shown in FIGS. 2 to 5, wall portions 36*a*, 37*a* are at a first angle to the longitudinal axis of the bolt, such first angle being greater in a forward direction than the second angle at which wall portions 36*b*, 37*b* lie to the bolt's longitudinal axis. The steeper angle of this wall portion causes the lug to be rotated toward angled wall 33 with a greater depressing force as compared to that of wall portion 37*b* which maintains the lug in its locked position against wall 33. An arrangement whereby the steeper angled wall 33 and the milder angled wall portion 37*b* abut against the lug in its locked position, serves to more positively lock the bolt in its closed position. Operating plate 23 therefore serves to force and lock the male conical surface 18 of the bolt into the female conical opening 13 of the firing chamber thereby effecting a tight air and tight gas seal. This tight seal is assured by wall portion 37*b* wedging against a side of the lug opposite the side at which the lug bears against wall 33, thus avoiding lug 19 disengaging from wall 33 upon firing. The lug is firmly held in this position until operating plate 23 moves rearwardly to thereby cause the bolt to move rearwardly, as wall portion 36*b* of the operating plate bears against the forward edge of the lug for unlocking same as it is moved away from wall 33. These end wall portions lie at angles to the longitudinal axis of the bolt which are opposite the angle at which angled abutment wall 33 lies in relation thereto. Lug 19 extends outwardly through wide openings 30*a* and 32 of the receiver and the guide plate, respectively, and further extends outwardly through opening 34 of the operating plate when the bolt is in its forwardly projected closed position of FIG. 2. The lug is rotated toward its position shown in FIG. 2 as end wall portion 37*a* makes contact therewith. While in the process of the bolt moving between its forwardly projected unlocked position and its retracted position, lug 19 extends outwardly through openings 30 and 31 of the receiver and guide plate, respectively, as well as through slot 34 so as to be guided by the side walls of openings 30 and 31 as shown in FIGS. 3 to 5 and 7.

The weapon is adapted for either fully automatic or semi-automatic firing. Also, it can be operated as a power driven weapon thus eliminating gas cylinder and piston unit 39 of the type to be hereinafter described.

A conventional magazine (not shown) adapted to contain a plurality of rounds R of ammunition is operatively attached to opening 38 of the receiver. Firing may be effected by means of a gas cylinder and piston unit 39 shown in FIG. 1 as having its cylinder in communication with bore 11 of the gun barrel by means of a passage 41 appropriately located along the length of the barrel to admit gas to the cylinder just before projectile P leaves the barrel and at a time when the residual gas pressure within the bore will be ample to automatically retract bolt 17 but insufficient to produce a dangerous rearward blast through breech opening 13. Piston 42 of unit 39 is normally located within its cylinder rearwardly of gas passage 41 so as to be forced rearwardly by the gases admitted into the cylinder. Its rearwardly projecting piston rod 43 is supported by the piston for endwise abutment with a release rod 44. The rod extends through a bearing clamp 45 and its rearward end is integrally connected with a link arm 46 of the cam plate. Also, release rod 44 and its connected cam plate are normally urged in a forward direction by means of a coil spring 47 which abuts against clamp 45 and is tensioned while in abutment with a suitable stop element (not shown) provided on the release rod. Moreover, operation of release rod 44 may be effected by either a plunger 48 or the gas cylinder and piston unit without interference with one another since piston rod 43 is normally not connected to the release rod but is in alignment therewith and is adapted to return to its normal inoperative or idle position at the end of each actuation by endwise pressure to the right transmitted through rod 44 from spring 47 as well as by the pressure of the gases or air trapped in the closed end of the cylinder.

Figure 3:
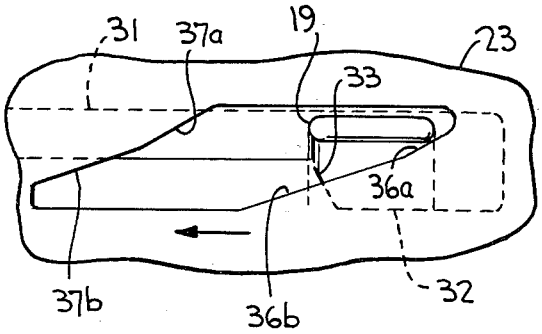

In operation, just before the fired round leaves the barrel, pressurized gas from the rear of projectile P is admitted to the gas piston and cylinder unit 39 through passage 41, thereby actuating the unit and its linkage means 43, 44 to automatically retract lug member 19 from its locked position shown in FIG. 2 to its slightly shifted unlocked position of FIG. 3 as end wall portion 36*b* of the operating plate opening is moved in a rearward direction and contacts the leading edge of the lug. By reason of this milder slope of wall portion 36*b*, the lug is smoothly and effectively shifted away from walls 33 so that, as the lug is contacted by wall portion 36*a*, it is quickly shifted into direct alignment with slots 30 and 31. Continued movement of the operating plate in the direction of the arrow of FIG. 3 causes the lug to be guided within slots 30 and 31 along the upper side walls thereof to thereby move the bolt toward its fully retracted poaition of FIG. 4. At such position, the rearward end of the bolt lug contacts the closed end of opening 31. When the bolt is retracted as in the manner aforedescribed, the residual gas pressure within the barrel effects an automatic reloading from the magazine in the customary manner. At the rearwardmost end of the bolt travel it is moved, with the assistance of coil spring 47, toward its forward projected position along the bottom side walls of slots 30 and 31 as end wall 37*a* of the operating plate opening pushes against the lug at its rearward edge as in FIG. 5. When the bolt reaches its forwardly projected closed position, its lug will extend through openings 30 and 32. The bolt is automatically locked while in its closed position as end wall 37*a* of the operating plate opening causes the lug to be shifted toward angled abutment walls 33 and in engagement therewith as wall portion 37*b* bears against the rearward edge of the lug for locking it in place as in the manner described with reference to FIG. 2.

Figure 5:
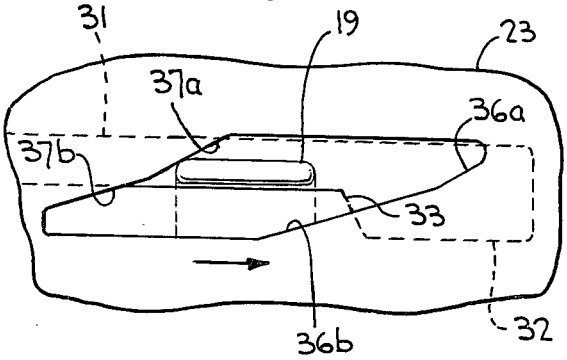

Bolt 17 shifts slightly by rotating about its longitudinal axis from its locked position of FIG. 2 to its unlocked and moving position of FIGS. 3 to 5. As an alternative, the bolt may be designed as in FIG. 8 so as to prevent any rotational movement thereof about its longitudinal axis. Accordingly, bolt 17' has a sleeve 51 at one end thereof, the sleeve having lug 19 secured thereto for shifting movement along therewith as in the direction of the arrow shown in this Figure. A dowel pin 52 on sleeve 51 loosely engages in a transverse groove 53 provided in the bolt so as to permit rotational movement while preventing axial movement of the sleeve with respect to the bolt. On the other hand, bolt 17' is prevented from rotating about its longitudinal axis although it must move axially in the bolt well of the receiver. Accordingly, an axial groove 54 is provided in the bolt and a dowel pin 55 is provided on the bolt well wall for cooperating with groove 54 so as to prevent rotational movement of the bolt.

From the foregoing, it can be seen that a simple yet highly effective bolt operating and loading mechanism has been devised for effecting an air tight and gas tight seal of the firing chamber for the firing of caseless ammunition and assisted rockets in both small and large caliber weapons. Such seal is effected by the engagement of conical sealing surfaces between the forward end of the bolt and the breech opening at the rearward end of the barrel. The bolt operating plate slides in a straightforward and rearward horizontal position with little resistance along a flat guide plate by means of anti-friction bearings located along its opposite sides. As the rearward steeper angled wall portion of the opening in the operating plate moves the bolt lug toward its forward position, it shifts the bolt lug forwardly and against the angled abutment walls on the receiver and the guide plate thus forcing the bolt's male portion conical sealing surface in a constantly forward pressurized position. This constant forward pressure is further effected as the rearward milder angled wall portion of the operating plate opening wedges against the bolt lug constantly forcing it forwardly and locking it firmly into position. The bolt is maintained in this locked position until the operating plate, after a predetermined amount of free rearward travel, unlocks the lug as its forward milder angled wall portion bears against the leading edge of the lug and moves it away from the abutment walls. The presently devised mechanism therefore serves to lock the bolt in its firing position, unlock it preparatory to retraction, guide the bolt rearwardly during retraction and guide it forwardly during its projected movement.

Also, the bolt can be a one-piece forging, which can be inserted during assembly in one piece through angled opening 30 at the rearward end of the receiver. The guide plate may thereafter be assembled in place. This therefore makes for easy manufacturing, assembly and maintenance.

Obviously, many modifications and variations of the present invention are made possible in the light of the above teachings. It is therefore to be understood that within the scope of the appended claims, the invention may be practiced otherwise than as specifically described.

What is claimed is:

1. In a closed breech automatic firing gun including a barrel having a bore extending therethrough and communicating at its rearward end with a receiver through a breech opening, said barrel defining a sealing surface around said breech opening, a bolt guided for projection and retraction movement in said receiver respectively toward and away from said breech opening and formed with a sealing surface for flush sealing engagement with said breech opening sealing surface in the forwardly projected position of said bolt, an outwardly extending lug connected to said bolt, a bolt operating and locking mechanism including a guide plate mounted on said receiver, a bolt operating plate having an opening therein and being slidably guided along said guide plate for movement parallel to said bolt movement into contacting engagement with said lug through said opening for moving said bolt between its projected and retracted positions, said guide plate having upstanding walls located along opposite sides thereof and spaced slightly outwardly of opposite sides of said bolt operating plate, anti-friction ball bearings located between said upstanding walls and said respective sides of said bolt operating plate to facilitate a smooth sliding movement of said bolt operating plate during automatic firing, an angled abutment wall on said receiver with which said lug engages for locking said bolt when in its forwardly projected position, a gas cylinder and piston unit communicating with said barrel for the reception of pressurized gas therefrom for actuating said unit with said bolt operating plate to retract it for unlocking said bolt and moving said lug away from said abutment wall incident to the firing of a round of ammunition through said barrel.

2. The closed breech gun according to claim 1, wherein said opening in said bolt operating plate has a rearward wall in engagement with the trailing edge of said lug when said bolt is in its locked position, and said opening having a forward wall spaced from the leading edge of said lug when said bolt is in said locked position, whereby said bolt is unlocked as said forward wall engages said leading edge after a slight time delay after movement of said bolt operating plate.

3. The closed breech gun according to claim 1, wherein said guide plate and said receiver each has openings therein through which said lug extends and is guided during movement of said bolt between its projected and retracted positions, said guide plate and receiver openings being wider at the forward ends thereof so as to define said angled abutment wall on said receiver and a superimposed angled abutment wall on said guide plate.

4. The closed breech gun according to claim 3, wherein said walls of said bolt operating plate lie at an angle to the longitudinal axis of said bolt opposite an angle at which said abutment walls lie.

5. The closed breech gun according to claim 3, wherein said receiver opening extends into the rearward end wall of said receiver to facilitate assembly of said bolt therethrough.

6. In a closed breech gun including a barrel having a bore extending therethrough and communicating at its rearward end with a receiver through a breech opening, said barrel defining a sealing surface around said breech opening, a bolt guided for projection and retraction movement in said receiver respectively toward and away from said breech opening and formed with a sealing surface for flush sealing engagement with said breech opening sealing surface in the forwardly projected position of said bolt, an outwardly extending lug on said bolt, a bolt operating and locking mechanism including a flat bolt operating plate having an opening therein, a guide plate mounted on said receiver and having upstanding walls located along opposite sides thereof, said bolt operating plate being slidably guided along said guide plate for movement parallel to said bolt movement into contacting engagement with said lug through said opening for moving said bolt between its projected and retracted positions, anti-friction ball bearings located between said upstanding walls and opposite sides of said bolt operating plate to facilitate a smooth sliding movement of said bolt operating plate during firing, an angled abutment wall on said receiver with which said lug engages for locking said bolt when in its forwardly projected position, a gas cylinder and piston unit communicating with said barrel for the reception of pressurized gas therefrom for actuating said unit, linkage means operatively interconnecting said unit with said bolt operating plate, whereby said bolt operating plate is retracted incident to the firing of a round of ammunition through said barrel whereupon said bolt is unlocked as said lug is moved away from said angled abutment wall, said bolt is retracted by said bolt operating plate and is thereby succeedingly projected forwardly into flush sealing engagement with said breech opening sealing surface.

7. The closed breech gun according to claim 5, wherein said bolt operating plate has cutout portions along said opposite sides thereof, said ball bearings being located within said cutout portions.

8. In a closed breech gun including a barrel having a bore extending therethrough and communicating at its rearward end with a receiver through a breech opening, said barrel defining a sealing surface around said breech opening, a bolt guided for projection and retraction movement in said receiver respectively toward and away from said breech opening and formed with a sealing surface for flush sealing engagement with said breech opening sealing surface in the forwardly projected position of said bolt, a rotatable sleeve provided on said bolt and having means thereon cooperating with said bolt for preventing axial movement with respect thereto, a lug on said sleeve, and means on said receiver cooperating with said bolt for preventing rotational movement thereof, a bolt operating and locking mechanism including a bolt operating plate slidably guided on said receiver for movement parallel to said bolt movement into contacting engagement with said lug for moving said bolt between its projected and retracted positions, an angled abutment wall on said receiver with which said lug engages when in its forwardly projected position, a gas cylinder and piston unit communicating with said barrel for the reception of pressurized gas therefrom for actuating said unit, linkage means operatively interconnecting said unit with said operating plate to retract said operating plate for moving said lug away from said abutment wall incident to the firing of a round of ammunition through said barrel, and means for resiliently returning said bolt to its projected position.

9. In a closed breech gun including a barrel having a bore extending therethrough and communicating at its rearward end with a receiver through a breech opening, said receiver defining a conical sealing surface around said breech opening, a bolt guided for projection and retraction movement in said barrel respectively toward and away from said breech opening and formed with a conical sealing surface for flush sealing engagement with said breech opening sealing surface in the forwardly projected position of said bolt, an outwardly extending lug on said bolt, a bolt operating and locking mechanism including a guide plate mounted on said receiver, a bolt operating plate slidably guided along said guide plate for movement parallel to said bolt movement into contacting engagement with said lug for moving said bolt between its projected and retracted positions, an angled abutment wall on said receiver with which said lug engages when in its forwardly projected position, a gas cylinder and piston unit communicating with said barrel for the reception of pressurized gas therefrom for actuating said unit, linkage means operatively interconnecting said unit with said cam plate to retract said cam plate for moving said lug away from said abutment wall incident to the firing of a round of ammunition through said barrel, and means for resiliently returning said bolt to its projected position, said bolt operating plate having an opening into which said lug extends, said opening being defined by side walls spaced a distance apart substantially greater than the thickness of said lug, and said opening being further defined by forward and rearward walls spaced a distance apart substantially greater than the length of said lug, said forward and rearward walls each having first and second wall portions respectively disposed on opposite sides of said lug when said bolt is in its forwardly projected position, said wall portions being disposed at angles to the longitudinal axis of said bolt, the angle of said first wall portions being greater than the angle of said second wall portions so that said lug is forced against said abutment wall by said rearward first wall portion in the forwardly projected position of said bolt and is wedged in said forwardly projected position by said rearward second wall portion to effect a tight air and tight gas seal between said engaging sealing surfaces.

10. The closed breech gun according to claim 8, wherein said guide plate and said receiver each have openings therein through which said lug extends and is guided during movement of said bolt between its projected and retracted positions, said guide plate and receiver openings being wider at the forward ends thereof so as to define said abutment wall on said receiver and a superimposed angled abutment wall on said guide plate.

11. The closed breech gun according to claim 10, wherein said receiver opening extends into the rearward end wall of said receiver to facilitate assembly of said bolt therethrough.

12. The closed breech gun according to claim 8, wherein said abutment wall lies at an angle to said longitudinal axis which is opposite to said angles of said wall portions.

13. In a closed breech gun including a barrel having a bore extending therethrough and communicating at its rearward end with a receiver through a breech opening, said receiver defining a conical sealing surface around said breech opening, a bolt guided for projection and retraction movement in said barrel respectively toward and away from said breech opening and formed with a conical sealing surface for flush sealing engagement with said breech opening sealing surface in the forwardly projected position of said bolt, an outwardly extending lug on said bolt, a bolt operating and locking mechanism including a guide plate mounted on said receiver, a bolt operating plate slidably guided along said guide plate for movement parallel to said bolt movement into contacting engagement with said lug for moving said bolt between its projected and retracted positions, an angled abutment wall on said receiver with which said lug engages when in its forwardly projected position, said bolt operating plate having an opening into which said lug extends, said opening being defined by side walls spaced a distance apart substantially greater than the thickness of said lug, and said opening being further defined by forward and rearward walls spaced a distance apart substantially greater than the length of said lug, said forward and rearward walls each having first and second wall portions respectively disposed on opposite sides of said lug when said bolt is in its forwardly projected position, said wall portions being disposed at angles to the longitudinal axis of said bolt, the angle of said first wall portions being greater than the angle of said second wall portions so that said lug is forced against said abutment wall by said rearward first wall portion in the forwardly projected position of said bolt and is wedged in said forwardly projected position by said rearward second wall portion to effect a tight air and tight gas seal between said engaging sealing surfaces, and means connected to said bolt operating plate for retracting said operating plate for movement of said lug away from said abutment wall as said forward second wall smoothly engages a leading edge of said lug.

14. The closed breech gun according to claim 12, wherein said guide plate and said receiver each have openings therein through which said lug extends and is guided during movement of said bolt between its projected and retracted positions, said guide plate and receiver openings being wider at the forward ends thereof so as to define said abutment wall on said receiver and a superimposed angled abutment wall on said guide plate.

15. The closed breech gun according to claim 14, wherein said receiver opening extends into the rearward end wall of said receiver to facilitate assembly of said slot therethrough.

16. The closed breech gun according to claim 12, wherein said abutment wall lies at an angle to said longitudinal axis which is opposite to said angles of said wall portions.

* * * * *